US005526555A

United States Patent [19]

Battistella et al.

[11] Patent Number: 5,526,555

[45] Date of Patent: Jun. 18, 1996

[54] FASTENING DEVICE, PARTICULARLY FOR SPORTS SHOES

[75] Inventors: Mirco Battistella, Spresiano; Roberto Gorza, Feltre; Giancarlo Foscaro, Treviso, all of Italy

[73] Assignee: Nordica S.p.A, Trevignano (Prov. Treviso), Italy

[21] Appl. No.: 352,019

[22] Filed: Dec. 8, 1994

[30] Foreign Application Priority Data

Dec. 21, 1993 [IT] Italy ..... TV93A0118
Feb. 17, 1994 [IT] Italy ..... TV94A0017

[51] Int. Cl.[6] ..... A43C 11/00

[52] U.S. Cl. ..... 24/68 SK; 24/69 SK; 24/71 SK

[58] Field of Search ..... 24/68 SK, 69 SK, 24/70 SK, 71 SK, 68 R

[56] References Cited

U.S. PATENT DOCUMENTS

| | | | |
|---|---|---|---|
| 3,258,820 | 7/1966 | Steinberg | 24/70 SK |
| 4,112,557 | 9/1978 | Salomon | 24/69 SK |
| 4,433,457 | 2/1984 | Chalmers, II et al. | 24/68 SK |
| 4,453,290 | 6/1984 | Riedel . | |
| 4,470,175 | 9/1984 | Chiarella | 24/70 SK |
| 5,172,454 | 12/1992 | Martignago | 24/69 SK |

FOREIGN PATENT DOCUMENTS

| | | | |
|---|---|---|---|
| 0084037 | 10/1964 | France | 24/70 SK |
| 2373981 | 8/1978 | France | 24/68 SK |
| 2432280 | 2/1980 | France . | |

*Primary Examiner*—Victor N. Sakran
*Attorney, Agent, or Firm*—Guido Modiano; Albert Josif

[57] ABSTRACT

Fastening device, particularly for fastening two flaps of a sports shoe, including an engagement element for being rigidly coupled to a first flap, a traction element, and a lever arm that is rotatably associated a with a first pivot interposed between a first pair of wings that protrudes from a base for being associated with a second flap to be fastened. The back of the lever arm interacts with the traction element to allow to lock the traction element adjacent to the base and to subsequently place the lever arm, with no forces applied to it, in the direction of the engagement element. The lever arm has a very limited protrusion and a secondary lever is provided to allow the rapid and easy release of the traction element.

32 Claims, 7 Drawing Sheets

FASTENING DEVICE, PARTICULARLY FOR SPORTS SHOES

BACKGROUND OF THE INVENTION

The present invention relates to a fastening device particularly for sports shoes and particularly for ski boots or skates.

Numerous levers used in ski boots are currently known; for this purpose, Italian Patent no. 1039897 discloses a lever constituted by an arm which is pivoted at one end, by means of an appropriate pivot, to two shoulders which are rigidly coupled to a flap of the boot; the arm has a toothed region for interaction with the end of a hook that can be associated, at its other end, with the other flap of the boot to be closed.

This known lever must have a surface finish that is aesthetically adequate, because it is visible on the boot; this accordingly entails the use of materials, such as aluminum or plastics, that have an attractive outward appearance for the skier, but such materials do not have the high-level strength characteristics required to withstand the stresses and impacts to which they are subjected during sports practice.

In any case, the protrusion of the levers with respect to the lateral surface of the boot does not give said boot a clean aesthetic appearance, as said levers tend to accidentally open or break in case of impact with the snow-covered piste or with the slalom pole or with the other boot.

The lever is furthermore subjected to loads when closed, and this increases the possibility of breakage.

As a partial solution to these drawbacks, Italian Patent 1054289 discloses a closure assembly for ski boots which, despite using a simplified structure, has been found to be difficult to close due to the limited hand resting surface to which the closing effort must subsequently be applied.

Italian patent no. 1,082,434 is also known which discloses a lever device for closing a ski boot; said device comprises a toothed band, which is rigidly coupled to a flap of the upper, and a lever, which is rigidly coupled to the other flap of the upper and has a ratchet-like advancement system which cooperates with the toothed band so as to close the boot.

This solution allows to increase the degree of tension of the toothed band while maintaining the previously achieved degree of fastening, but at the same time it has other drawbacks which are due essentially to its structural complexity and to the difficulty in operating it, because it is necessary to place the tip of the lever, which is pivoted at the end of the lever, at the interspace between two adjacent teeth of the band, so that jamming does not occur during the closure of the lever; in order to obviate this drawback, it is necessary to perform several movements with very limited take-ups.

The tip of the lever furthermore has a central recess that forms two lateral tabs which are the only part that interacts with the teeth of the underlying band: this configuration, which is necessary to avoid interacting with the lever produces further drawbacks due to the possibility of deforming said tabs, consequently making it impossible to adjust the closure.

In any case, the lever still protrudes vertically with respect to the band and thus to the flap of the upper; furthermore, the possible forming of ice or the accumulation of snow at the lever can make said lever disengage from the toothed band in case of accidental impacts, thus causing the device to open.

Italian Utility Model patent no. 185645 filed on Jan. 20, 1981 discloses a lever closure system, particularly for motorcycling boots, in which the arm of the lever, which is again pivoted at one end at a suitable support that is rigidly coupled to one flap, is inserted within suitable notches provided on another flap to be closed.

Even this solution, while having a limited number of components, has some drawbacks, such as the direct interaction of the lever arm with the flap to be closed, which entails breakages or deformations due to the different strength of the materials that are in mutual contact.

French patent, published as no. 2432280 and filed on Aug. 3, 1978 discloses a closure device which is again constituted by a U-shaped lever arm the wings of which are again pivoted, at their ends, at a suitable support which is rigidly coupled to a flap; a pivot is interposed between said wings and interacts with a suitable rack that is obtained from the other flap to be joined and protrudes from it.

This solution has drawbacks owing to the fact that the engagement between the lever arm and the rack is not always reliable, because the rack must necessarily be made of plastics, together with the flap of the boot, and therefore be made of a material that does not withstand the intense stresses applied while skiing.

Among the various described situations, the same Applicant of the above mentioned French patent in fact provides for the use of an individual lever arm which has a toothed region that interacts with an adapted pivot which is associated transversely with respect to the wings of a U-shaped bar which is pivoted to the other flap to be joined so that said bar can oscillate about one edge.

Even this solution therefore has the drawbacks described above, which it combines with a difficult closing operation for the skier, who must make the lever arm rotate practically through 180°.

As a partial solution to this drawback, Italian Utility Model no. 182322 discloses a closure device particularly for ski boots in which there is a lever arm that is pivoted, at one end, at one of the flaps to be fastened; the end of a traction element is articulated to a median portion of said lever element, and said traction element has, at its opposite end, a hook-like element which can be coupled in an engagement seat provided at the other flap to be fastened; said traction element has means for adjusting its useful length and has at least one substantially flexible portion.

Even this solution, however, constructively includes a large number of components and furthermore protrudes beyond the profile of the boot; the closure device is furthermore considerably elongated along its longitudinal axis, which affects a very large region of the boot.

As a partial solution to these drawbacks, Japanese Patent application no. 3-318673 of Nov. 7, 1991 discloses a lever for sports shoes, particularly for boot,, the particularity of which is the fact that it comprises a lever arm which is totally or partially associated or associable at at least one suitable seat formed on one of said flaps; at least one grip element for engagement means provided on said lever arm is associated on the other one of said flaps.

Although it is undoubtedly valid, even this described solution has drawbacks, because it has been found that the connection between the lever arm and the seat formed on the flaps is not optimum; moreover, it has been found that it is necessary to modify the setting of the degree of tension that can be applied with the lever.

Therefore, the several drawbacks that have been observed in the described prior art include the provision of levers which are subjected to loads once fastening has occurred and thus after closing said lever, and the provision of levers which occupy a considerable bulk, especially in a vertical direction.

SUMMARY OF THE INVENTION

The principal aim of the present invention is therefore to solve the described technical problems by eliminating the drawbacks described above in the prior art and thus providing a fastening device which is associable in an optimum manner with the flaps of a sports shoe, such as a boot or a skate, and allows to ensure optimum adjustment of the mutual fastening of the two flaps to be joined despite having a very limited vertical space occupation with respect to the outer profile of the shoe.

An important object is to provide a fastening device which despite including a lever arm that can be operated by the user allows to protect said lever arm from stresses caused by the loads required to keep the flaps of the shoe fastened, and thus allows to reduce the risk of possible breakages caused by the loads applied throughout the period of use of the boot on the feet.

Another object is to provide a device which is structurally simple and can be manufactured with a limited number of components.

Another important object is to provide a device in which the traction element can be easily replaced even by the user himself without requiring particular tools.

Another object is to provide a device that allows to rapidly and easily unfasten the flaps.

Another object is to provide a device that is not subject to accidental opening actions caused by pressures or impacts applied to it.

Another object is to provide a device that is reliable and safe in use.

According to the invention, there is provided a fastening device, particularly for fastening two flaps of sports shoes, comprising a first engagement element for being rigidly coupled to a first flap and a traction element that interacts with said first engagement element, characterized in that it comprises a lever arm that is rotatably associated with a first pivot which is interposed between a first pair of wings that protrudes from a base associated with a second flap to be fastened, said lever arm interacting on its back with said traction element to lock said traction element to a second engagement element which is arranged adjacent to said base and to subsequently place said lever arm, which bears no load, in the direction of said first engagement element, means being provided for releasing said traction element.

BRIEF DESCRIPTION OF THE DRAWINGS

The particular characteristics and advantages of the invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
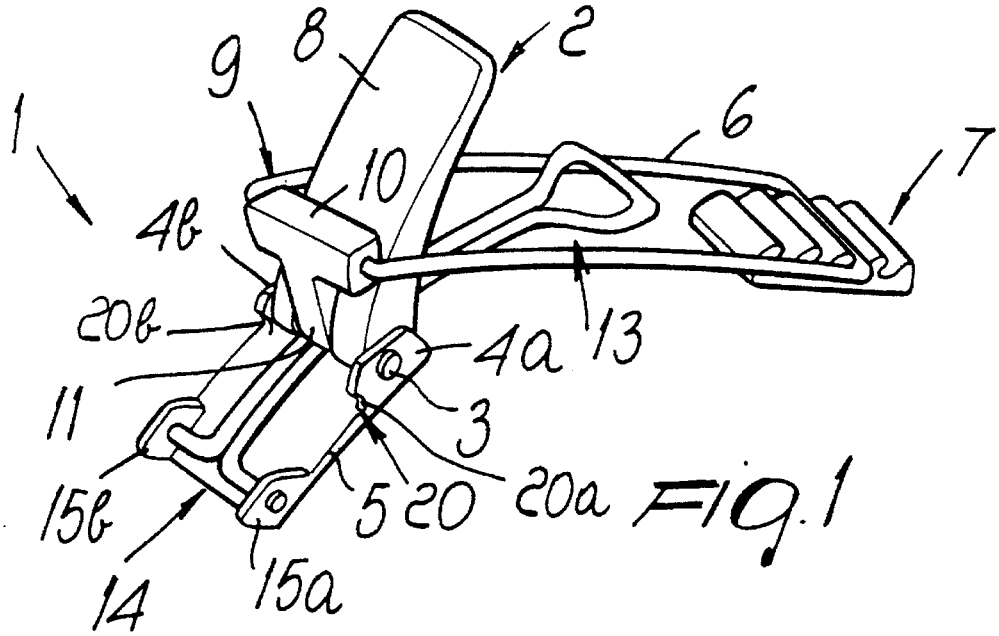
FIG. 1 is a perspective view of a first embodiment the device according to the invention, during fastening.
Figure 2:
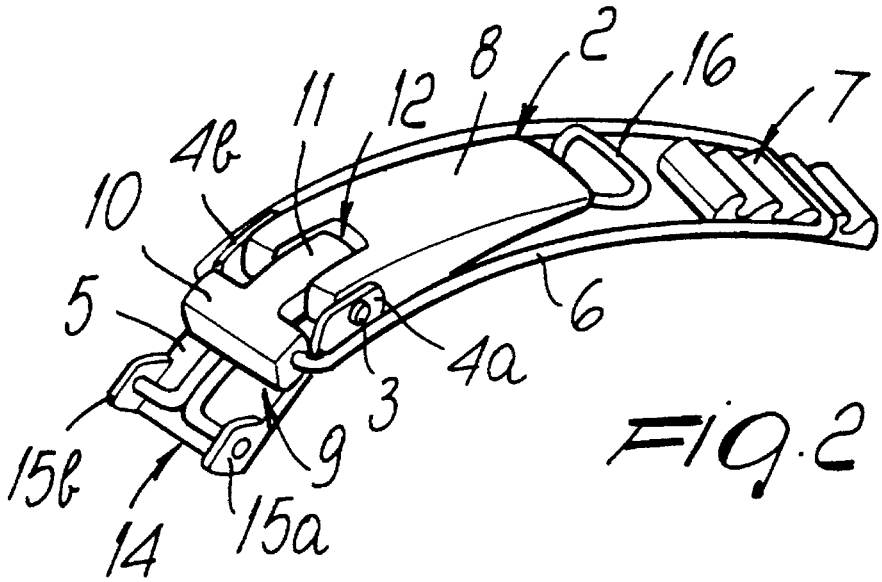
FIG. 2 is a view, similar to the preceding one, of the device after fastening.
Figure 3:
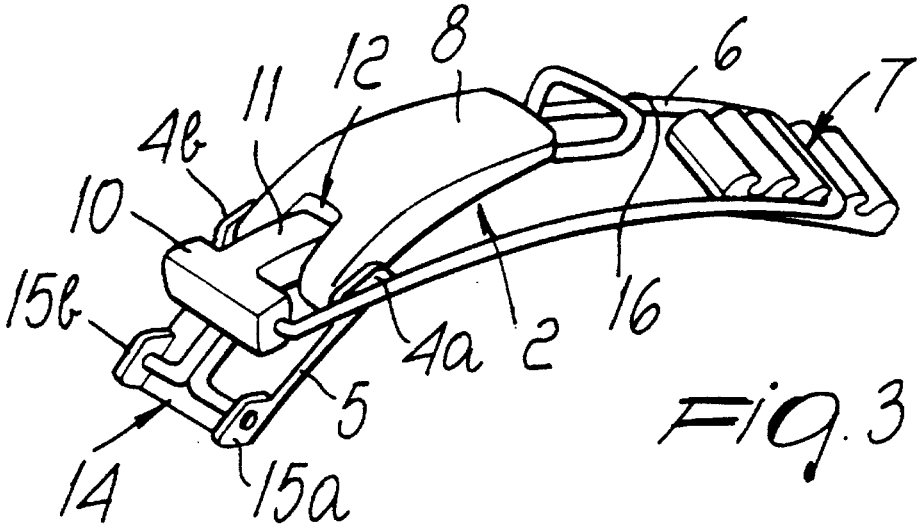
FIG. 3 is a view, similar to the preceding one, of the condition for fastening.

With reference to FIGS. 1–3, the reference numeral 1 designates the fastening device, which is particularly usable in sports shoes, such as for example ski boots, roller skates, or ice skates, which comprise at least a first flap and a second flap to be mutually fastened.

The fastening device comprises a lever arm 2 which is rotatably associated, at one end, at a first pivot 3 which is interposed transversely between a first pair of wings **4*a* and 4*b* which protrude from a base 5** which is associated for example at the second flap of the shoe.

The fastening device is furthermore constituted by a traction element 6, such as for example a hoop, which can be selectively associated, at one end, with a first engagement element 7, such as for example a rack, that is associable with the first flap of the shoe.

The lever arm 2 is articulated to the first pivot 3 so that its back 8, and thus its convex part that does not face the flaps in closed condition, interacts with the traction element 6 by means of the interposition of a connecting element 9.

Said connecting element is preferably constituted by a T-shaped body whose head 10 is rotatably associated with the end of the traction element 6 that does not interact with the engagement element 7; the stem 11 of said body is rotatably associated at the first pivot 3, and the corresponding end of the lever arm 2 has a suitable longitudinal seat 12 for accommodating said stem.

The longitudinal extension of the stem 11 is such as to allow to place the head 10, after closing the first and second flaps, at a second engagement element 20 which is arranged adjacent to the base 5 beyond the first pair of wings 4*a* and 4*b*; said second engagement element 20 comprises a pair of recesses 20*a* and 20*b* which allow engagement of the traction element 6.

In order to fasten the first and second flaps, the user in fact rotates the lever arm 2 towards the base 5, as shown in FIG. 1: in this manner, the back 8 of the lever arm 2 rotates the connecting element 9, which is arranged adjacent to the base 5, thus locking one end of the traction element 6 at the pair of recesses 20*a* and 20*b*.

Once fastening has been achieved, the user can further rotate the lever arm 2, this time towards the first engagement element 7; the lever arm bears no loads and affects a part of the shoe which is not subject to accidental impacts against the snow-covered piste or slalom poles, and said lever arm can be accommodated within the hoop that constitutes the traction element.

The fastening device furthermore comprises means for releasing the traction element; said means are constituted by a secondary lever 13 which is arranged at a plane which is interposed between the plane of the base 5 and the plane of the overlying lever arm 2 in the inactive, and thus load-free, condition shown in FIG. 2.

The secondary lever 13 is preferably obtained by bending an appropriate metal wire which has a first end 14 that is essentially T-shaped and is pivoted at a second pair of wings 15*a* and 15*b* which advantageously protrudes from the base 5 in a region that is adjacent to the head 10 of the connecting element 9 once the first and second flaps have been fastened.

The secondary lever 13 then has a portion that lies below the connecting element 9 and the lever arm 2, so as to have a second end 16 which is preferably ring-shaped, protrudes beyond the tip of the lever arm, and is directed slightly towards said tip so as to allow the user to grip it easily and quickly for example with one finger.

In this manner it is possible to produce a first lifting of the connecting element 9 until the axis about which the head 10 is pivoted to the traction element 6 is arranged beyond the pivoting axis of the first pivot 3, thus achieving the immediate opening of the device.

It has thus been observed that the invention has achieved the intended aim and objects, a fastening device having been provided which has small dimensions both vertically and along the profile of the shoe and furthermore is less prone to breakage of the lever arm since said arm is not loaded by stresses while skiing.

The device furthermore has a high degree of safety against accidental disengagements, because the lever arm is not active in closed condition or can be disengaged from said device and because disengagement cannot be achieved by applying pressures to any part of the device.

Figure 4:
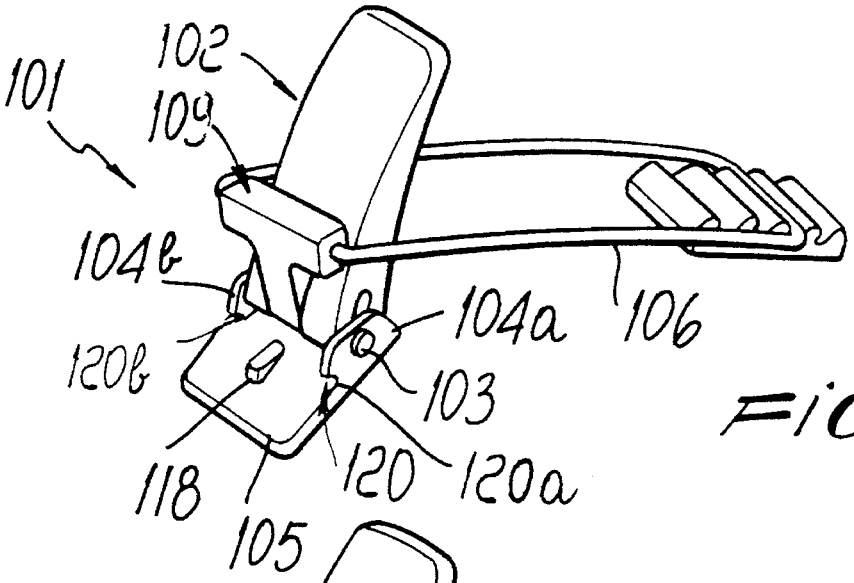
FIG. 4 is a perspective view of a second embodiment of the device according to the invention, during fastening.
Figure 5:
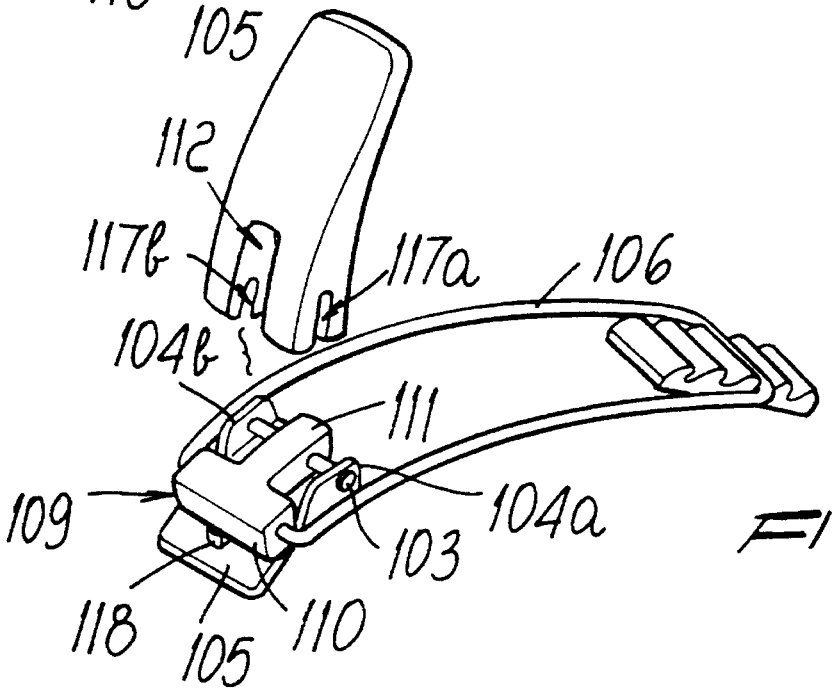
FIG. 5 is a view of the embodiment of FIG. 4 after fastening.
Figure 6:
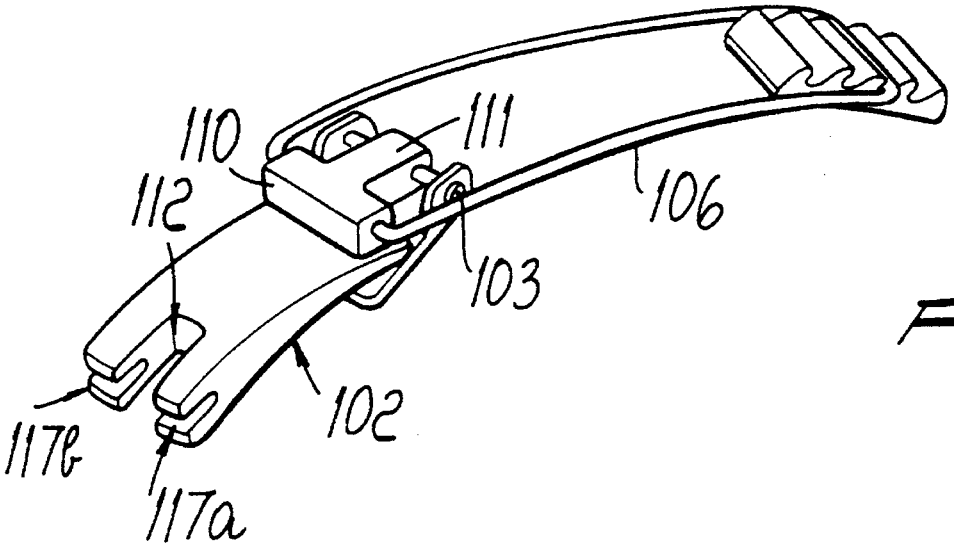
FIG. 6 is a view of the embodiment of FIGS. 4 and 5, of the condition for unfastening.

FIGS. 4, 5, and 6 illustrate another embodiment for a fastening device 101 in which the lever arm 102 is detachably associable at the first pivot 103 for the pivoting of the stem 111 of the connecting element 109 to the first pair of wings 104a and 104b which protrudes from the base 105.

This is allowed because the end of the lever arm 102 that is adjacent to the seat 112 for the stem 111 has a suitable pair of slots 117*a* and 117*b* for engagement with the first pivot 103.

Fastening can be achieved in a manner that is similar to the one described above, whereas the lever arm 102 can be for example stored in a pocket once fastening has been achieved.

This allows on one hand to have a single lever arm regardless of the number of fastening devices present in the shoe, and on the other hand to further reduce the space occupied on said shoe.

The means for releasing the traction element 106 are essentially constituted by the tip of the lever arm 102 that does not interact with the first pivot 103; said tip can be inserted in the interspace between the head 110 of the connecting element 109 and the base 105 in the fastened condition; said insertion is preferably facilitated by the presence, at said base 105, of a protrusion 118 that lies below the stem 111 and has a wedge-like shape.

This solution, too, accordingly allows to achieve the intended aim and objects, with the addition of a reduction in the overall number of components, as it is possible to require a single lever arm regardless of the number of fastening devices applied.

Figure 7:
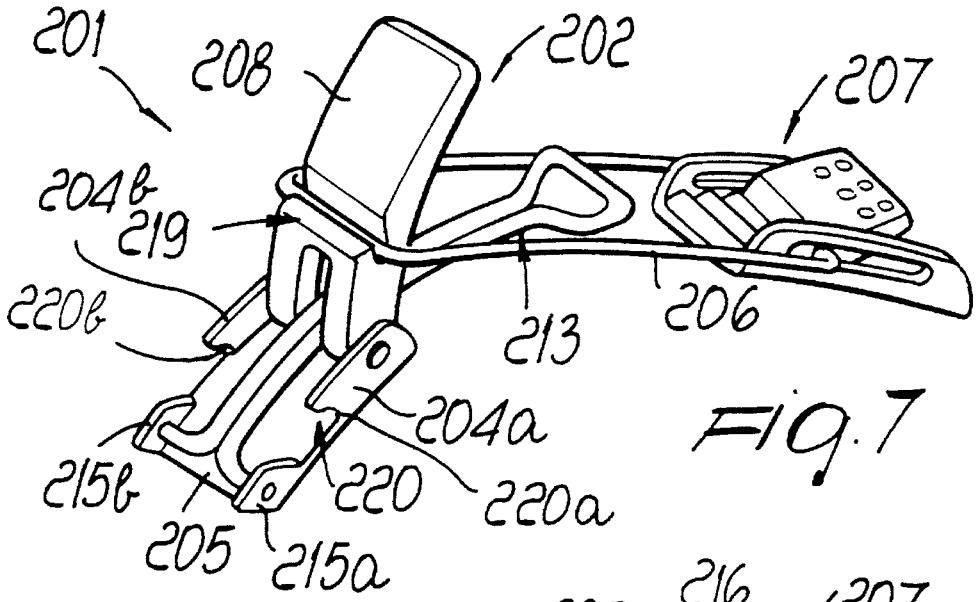
FIG. 7 is a perspective view of a third embodiment of the device according to the invention, during fastening.
Figure 8:
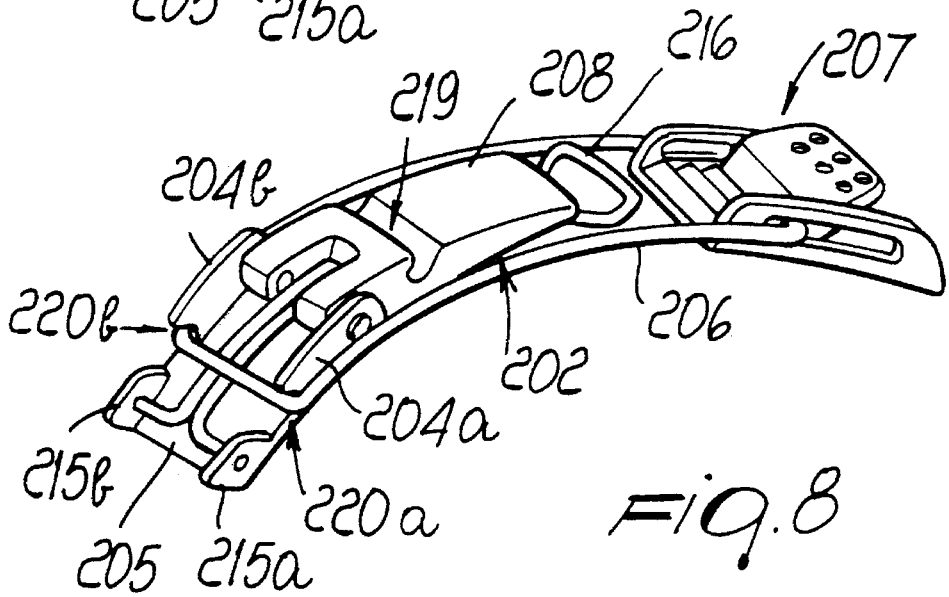
FIG. 8 is a view of the embodiment of FIG. 7 after fastening.
Figure 9:
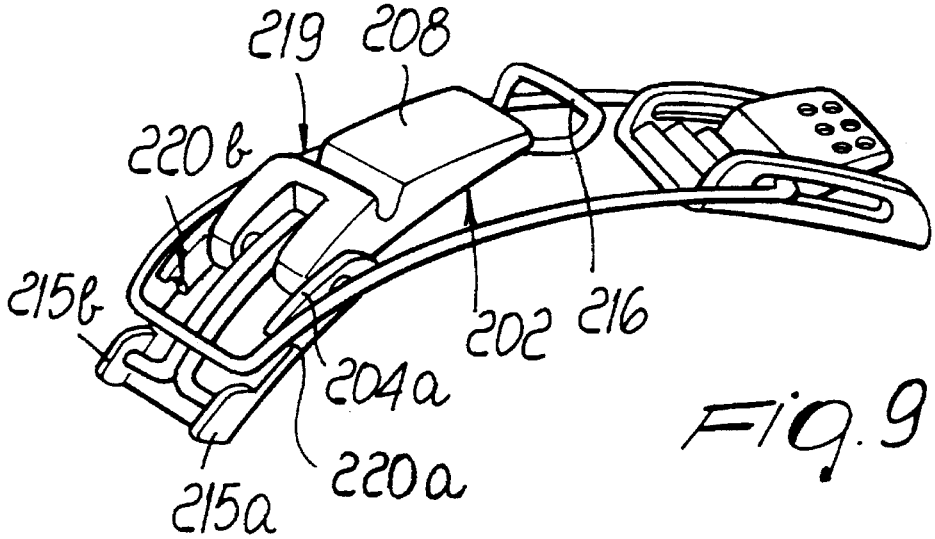
FIG. 9 is a view of the embodiment shown in FIGS. 7 and 8, of the condition for unfastening.

FIGS. 7, 8, and 9 illustrate a further embodiment for a fastening device 201, wherein an engagement seat 219 for one end of the traction element 206 is formed transversely on the back 208 of the lever arm 202; the traction element 206 is or can be rigidly coupled, at its other end, to a first engagement element 207 which comprises for example an element that interacts in a ratchet-like manner, and thus selectively, with a rack.

During the final step of the fastening of the traction element 206, its end accommodated within the engagement seat 219 is caused to move by said engagement seat towards a second engagement element 220 which is located in a region that is adjacent to the first pair of wings 204*a* and 204*b*.

Said second engagement element 220 comprises two recesses 220*a* and 220*b* which allow to engage the end of the traction element 206.

Unfastening occurs as described in the first embodiment and thus by lifting the second end 216 of the secondary lever 213.

This solution, too, therefore allows to achieve the intended aim and objects; the presence of the engagement seat 219 facilitates the interaction between the back of the lever arm and the traction element.

FIGS. 10–19 illustrate a fourth embodiment in which the reference numeral 301 designates the fastening device which comprises a lever arm 302 which is rotatably associated, at one end, at a first pivot 303 which is interposed transversely between a first pair of wings 304*a* and 304*b* which protrude from a base 305 which is associated for example at the second flap of the shoe.

The fastening device furthermore comprises a traction element 306, such as for example a hoop, which can be selectively associated, at one end, with a first engagement element 307, such as for example a rack, that is associated with the first flap of the shoe.

The lever arm 302 is articulated to the first pivot 303 so that its back 308, and thus its convex part that does not face the flaps in closed condition, interacts with the traction element 306 by means of the interposition of a connecting element 309.

Said connecting element is preferably constituted by a T-shaped body whose head 310 is rotatably associated with the end of the traction element 306 that does not interact with the engagement element 307; the stem 311 of said body is rotatably associated at the first pivot 303, and the corresponding end of the lever arm 302 has a suitable longitudinal seat 312 for accommodating said stem.

The longitudinal extension of the stem 311 is such as to allow to place the head 310, after fastening the first and second flaps, adjacent to the base 305 beyond the first pair of wings 304*a* and 304*b*, so that the end of the traction element 306 that affects the head 310 is arranged on a plane that lies below the plane of the first pivot 303, so as to ensure stable fastening of said traction element 306.

Figure 15:
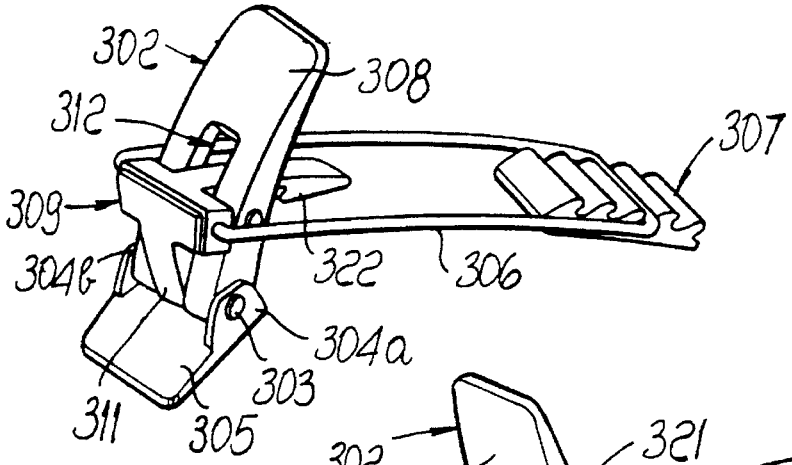
FIG. 15 is a view similar to FIG. 14, of the initial step for closing the device.
Figure 16:
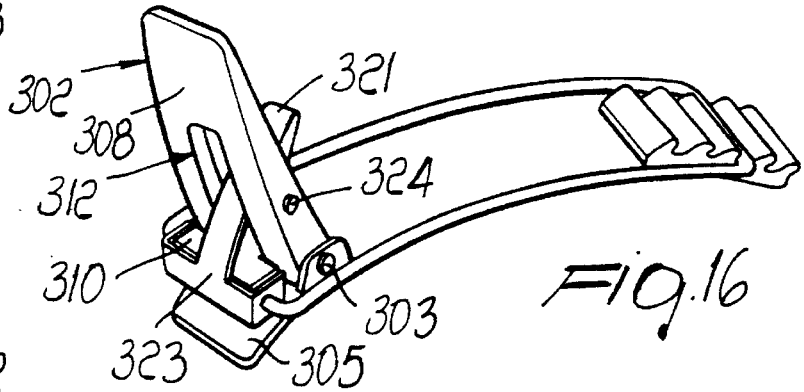
FIG. 16 is a view, similar to FIG. 15, of the arrangement of the device in closed condition.
Figure 17:
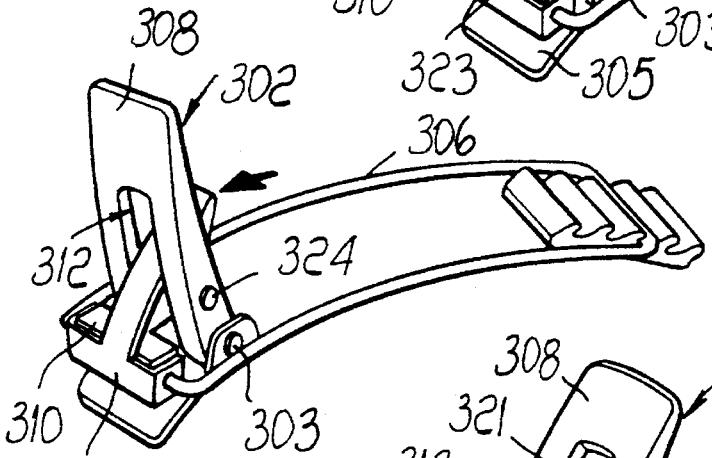
FIG. 17 is a view, similar to FIG. 16, of the step for the disengagement of the pawl from the second pivot located on the lever arm.
Figure 18:
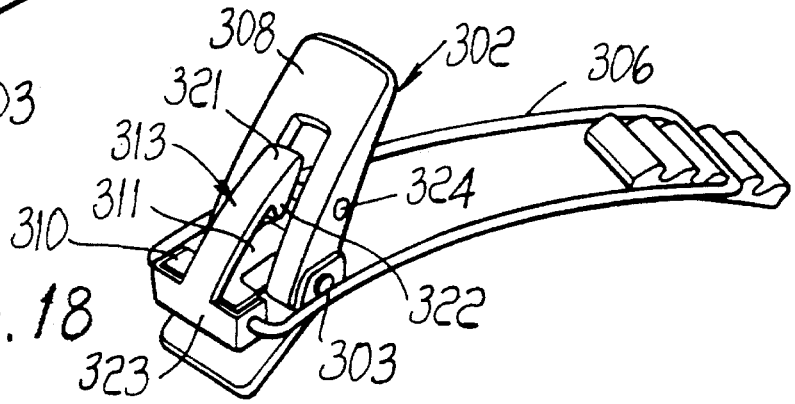
FIG. 18 is a view, similar to FIG. 17, of the condition in which the second pivot and the pawl have disengaged and the lever arm is starting to resume its position.

In order to fasten the first and second flaps, the user in fact rotates the lever arm 302 towards the base 305, as shown in FIG. 15: in this manner, the back 308 of the wings of the lever arm 302 rotates the connecting element 309, which is arranged adjacent to the base 305, thus stably placing the end of the traction element 306 adjacent to the base 305, as shown in FIG. 16.

Figure 19:
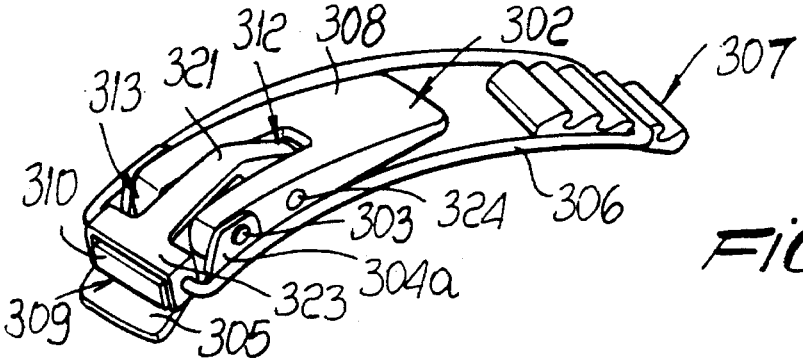
FIG. 19 is a view of the completed repositioning of the lever arm, as shown in FIG. 10.

The fastening device furthermore comprises means for releasing the traction element; said means are constituted by a T-shaped secondary lever 313 whose stem 321 is arranged, in the closed condition shown in FIG. 19, above the stem 311 of the connecting element 309; the free end of the stem 321 protrudes beyond the corresponding end of the stem 311 and has a pawl-like shape in which the engagement tooth 322 is directed towards the lever arm 302.

The secondary lever 313 has a head 323 that can be arranged adjacent to the head 310 of the connecting element 309; the tips of said head 323 are folded so that they are freely rotatably associated at said head 310 coaxially to the traction element 306, so as to allow the secondary lever 313 to rotate freely with respect to the head 310 of the connecting element 309.

The release means of the traction element are furthermore constituted by a second pivot 324 which is pivoted transversely between the wings of the lever arm 302 at said seat 312 and parallel to the first pivot 303.

Figure 12:
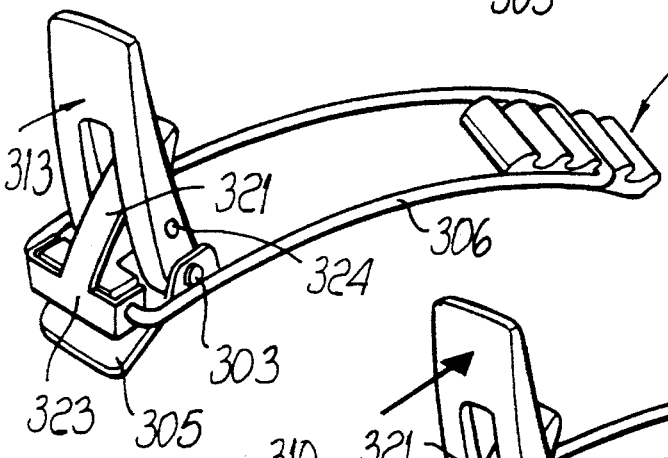
FIG. 12 is a view, similar to FIG. 11, of the interaction of the pawl with the second pivot associated with the lever arm.
Figure 13:
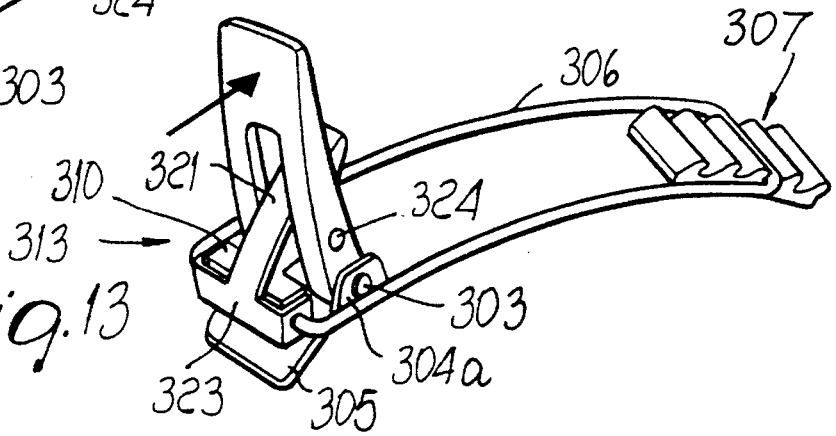
FIG. 13 is a view, similar to FIG. 12, of the initial step for opening the device.
Figure 14:
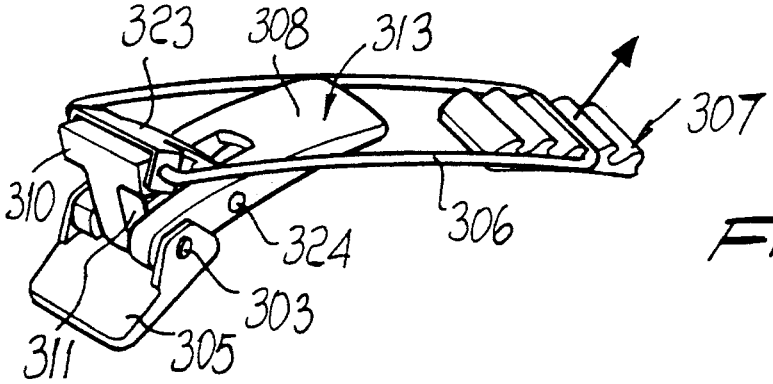
FIG. 14 is a view, similar to FIG. 13, of the released condition of the traction element.

The location of the second pivot 324 is such that it interacts, as shown in FIGS. 12, 13, and 14 as regards the opening of the device, with the tooth 322 that is present at the pawl-shaped end of the stem 321 of the secondary lever 313.

The use of the device is thus as follows: starting from the condition shown in FIG. 10, in which the device is in closed condition, the pawl-shaped end of the secondary lever 313 rests at the second pivot 324, the traction element 306 is subjected to tension, and the lever arm 302 is not affected by any load.

Figure 11:
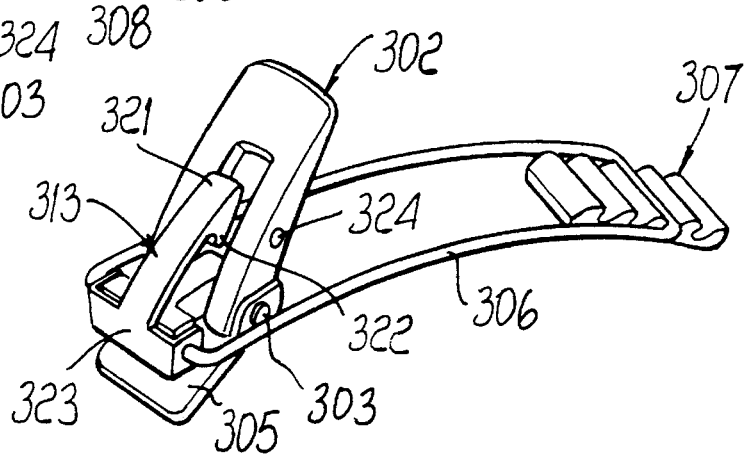
FIG. 11 is a view, similar to FIG. 10, of the lever arm in slightly raised position.

When said lever arm 2 is raised, as shown in FIGS. 11 and 12, this causes a rotation of the secondary lever 313, optionally in contrast with a spring located for example coaxially to the end of the traction element 306 that is rotatably associated with the head 310.

At a certain point, the lifting of the lever arm 302 causes the tooth 322 of the pawl-shaped end of the secondary lever 313 to interact with the second pivot 324; at this point, as shown in FIGS. 12, 13, and 14, the user rotates the lever arm 302 towards the engagement element 307, at the same time lifting the head 310 of the connecting element 309 and thus moving the end of the traction element 306 that is rotatably connected to said head beyond the first pivot 303 and therefore allowing disengagement from the engagement element 307 (FIG. 14).

During the closure step, shown in FIGS. 15 to 19, the lever arm 302 is rotated towards the base 305, so that the back 308 of the wings that are adjacent to the seat 312 interacts with the wings of the head 310 of the connecting element 309, forcing said connecting element to rotate and thus applying tension to the traction element 306.

Then, as shown in FIG. 16, the lever arm 302 forces the connecting element 309 to arrange itself so that its head 310 is adjacent to the base 305; the corresponding end of the traction element 306 is thus located below the first pivot 303 in a stable closed condition.

Figure 10:
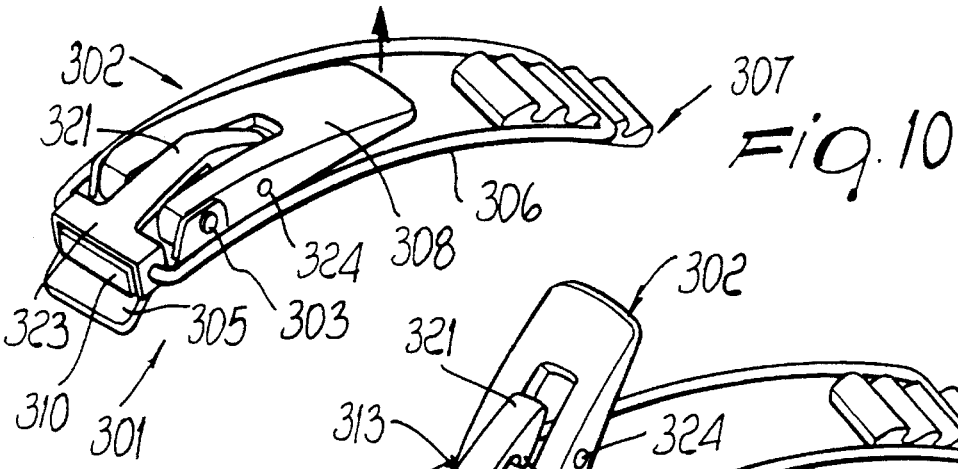
FIG. 10 is a perspective view of a fourth embodiment of the device according to the invention, during fastening.

The further rotation applied to the lever arm 302 causes the tooth 322 of the pawl-shaped end of the secondary lever 313 to disengage from the second pivot 324: at this point the user can support said pawl-shaped end with one finger, returning the lever arm 302, which is not affected by any load, towards the engagement element 307, so as to allow to place the secondary lever 313, as shown in FIGS. 10 and 19, above said second pivot 324.

It has thus been observed that the invention has achieved the intended aim and objects, a fastening device having been provided which has small dimensions both vertically and along the profile of the shoe and furthermore is less prone to breakage of the lever arm as said arm is not loaded by stresses while skiing.

In particular, the lever arm 302 does not protrude towards the sole of the shoe but is closed in the opposite direction: this is particularly important in the case of ski boots or skates, which assume highly laterally inclined positions during direction changes; it is thus possible to avoid contact of the levers with the ground, which if conventional levers are used can lead to their breakage and even make the user fall.

Dimensions are modest even when the device is open, considerably reducing the possibility of impacts and thus of breakages of the lever arm.

The device furthermore has a high degree of safety against accidental disengagements, as the lever arm is not active in closed condition and because unfastening cannot be achieved by applying pressures to any part of the device.

The use and the ergonomics of the device are also particularly advantageous, as the device is initially actuated during opening while the lever arm is not loaded: the effort required to lift the lever arm is therefore practically nil.

Furthermore, the placement of the arm towards the center of the boot, instead of towards the sole, allows to reduce the size constraints which are otherwise linked to the need to limit downward protrusion, as described above: a longer arm allows to increase the lever effect, thus reducing the closing effort.

Figure 20:
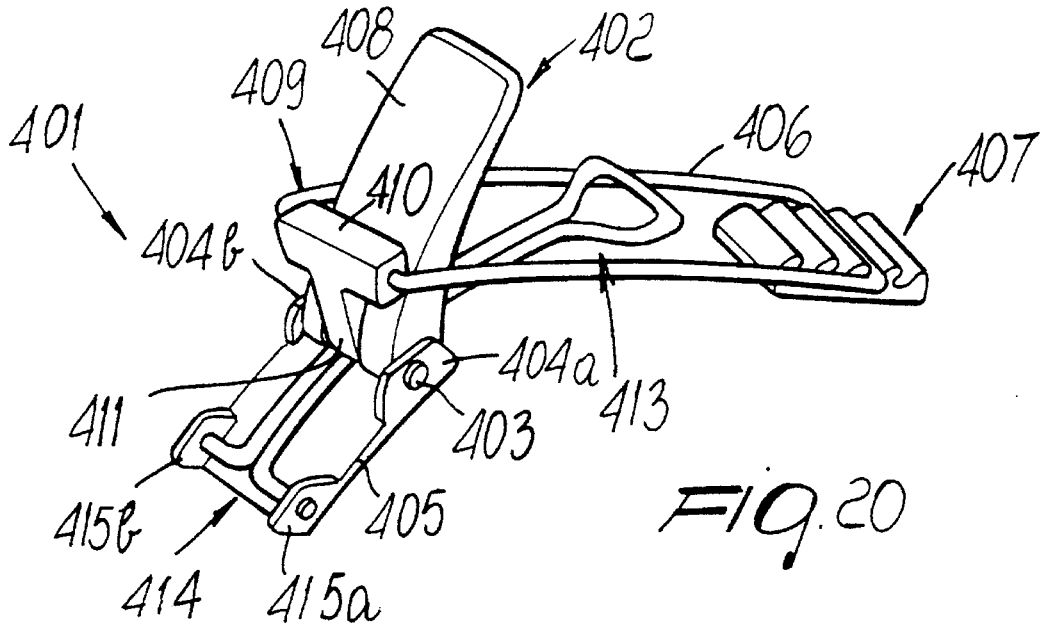
FIG. 20 is a perspective view of a fifth embodiment of the device according to the invention, during fastening.
Figure 21:
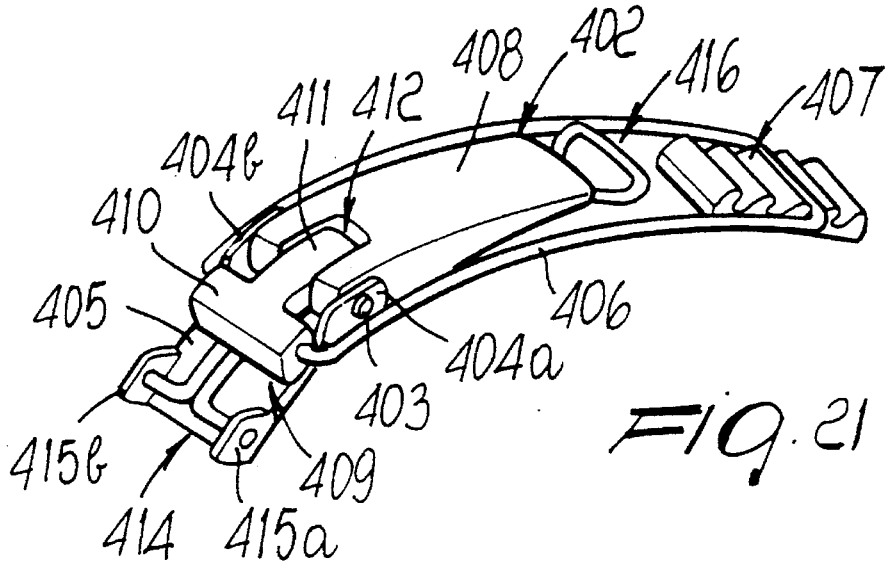
FIG. 21 is a view, similar to FIG. 20, of the device in fastened condition.
Figure 22:
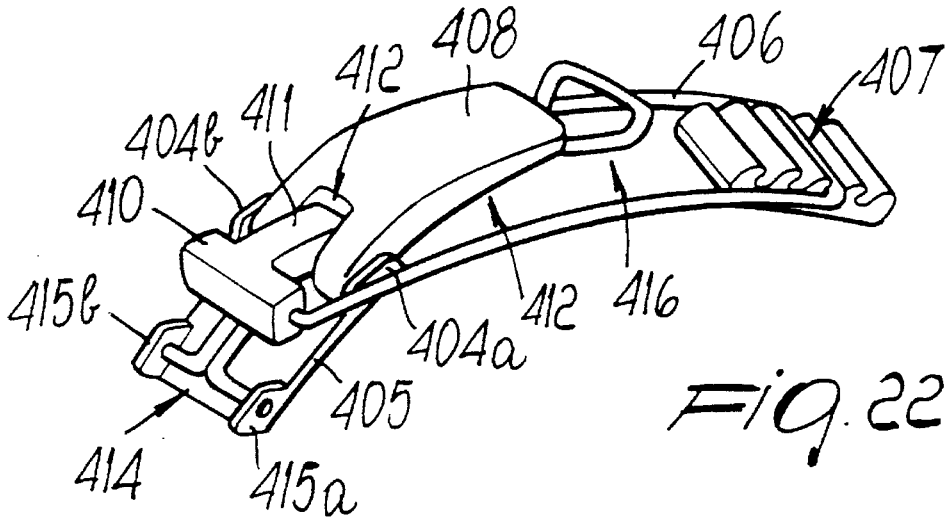
FIG. 22 is a view, similar to FIG. 21, of the condition for unfastening.

FIGS. 20, 21, and 22 illustrate another embodiment for a fastening device 401 which comprises a lever arm 402 which is rotatably associated, at one end, at a first pivot 403 which is transversely interposed between a first pair of wings 404*a* and 404*b* which protrude from the base 405 associated for example at the second flap of the shoe.

The traction element 406 is again selectively associable with an engagement element 407 that can be associated with the first flap of the shoe.

The lever arm 402 is articulated to the first pivot 403 so that its back 408, and thus its convex part that does not face the flaps in closed condition interacts with the traction element 406 by means of the interposition of a connecting element 409.

Said connecting element is preferably constituted by a T-shaped body; the head 410 of said body is rotatably associated with the end of the traction element 406 that does not interact with the engagement element 407, and the stem 411 of said body is rotatably associated at the first pivot 403; the corresponding end of the lever arm 402 has an appropriate longitudinal seat 412 for accommodating said stem.

The longitudinal extension of the stem 411 is such as to allow to place the head 410, once the first and second flaps have been fastened, adjacent to the base 405 below the plane of arrangement of the first pivot 403.

In order to fasten the first and second flaps the user in fact rotates, as shown in FIG. 20, the lever arm 402 towards the base 405; in this manner the back 408 of the lever arm 402 rotates the connecting element 409, which is arranged adjacent to the base 405, thus locking one end of the traction element 406 once said end is arranged adjacent to the base 405.

Once fastening has been achieved, the user can rotate the lever arm 402 further, this time towards the first engagement element 407; the lever arm is not loaded and affects a part of the shoe that is not affected by accidental collisions with the snow-covered piste or with slalom poles, and said lever arm can be accommodated within the hoop that constitutes the traction element.

The fastening device furthermore comprises means for releasing the traction element which are constituted by a secondary lever 413 that is arranged at a plane that is interposed between the plane of the base 405 and the plane of the overlying lever arm 402 in the inactive, and thus unloaded, condition shown in FIG. 21.

The secondary lever 413 is preferably obtained by bending an appropriate metal wire which has a first end 414 that is essentially T-shaped and is pivoted at a second pair of wings 415*a* and 415*b* that advantageously protrudes from the base 405 in a region that is adjacent to the head 410 of the connecting element 409 once the first and second flaps have been fastened.

The secondary lever 413 then has a portion that lies below the connecting element 409 and the lever arm 402 so as to have a second end 416 which is preferably ring-shaped, protrudes beyond the tip of the lever arm, and is directed slightly towards said lever arm so as to allow the user to grip it easily and rapidly, for example with a finger.

In this manner it is possible to initially lift the connecting element 409 until the axis about which the head 410 is pivoted to the traction element 406 lies beyond the pivoting axis of the first pivot 403, thus opening the device immediately.

It has thus been observed that this solution, too, has achieved the intended aim and objects, a fastening device having been provided which has small dimensions both vertically and within the profile of the shoe and furthermore is less subject to lever arm breakage since said lever arm is not loaded by stresses while skiing.

Figure 23:
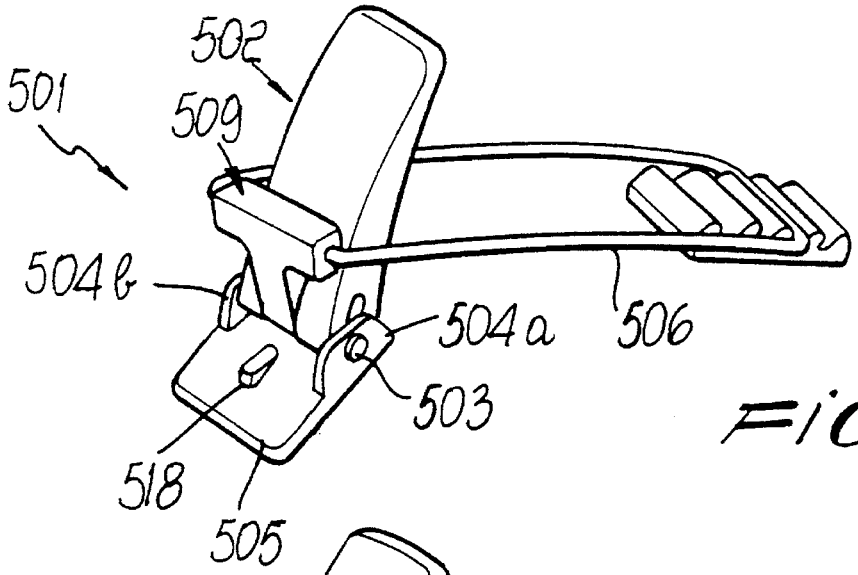
FIG. 23 is a view, similar to FIG. 19, of another embodiment.
Figure 24:
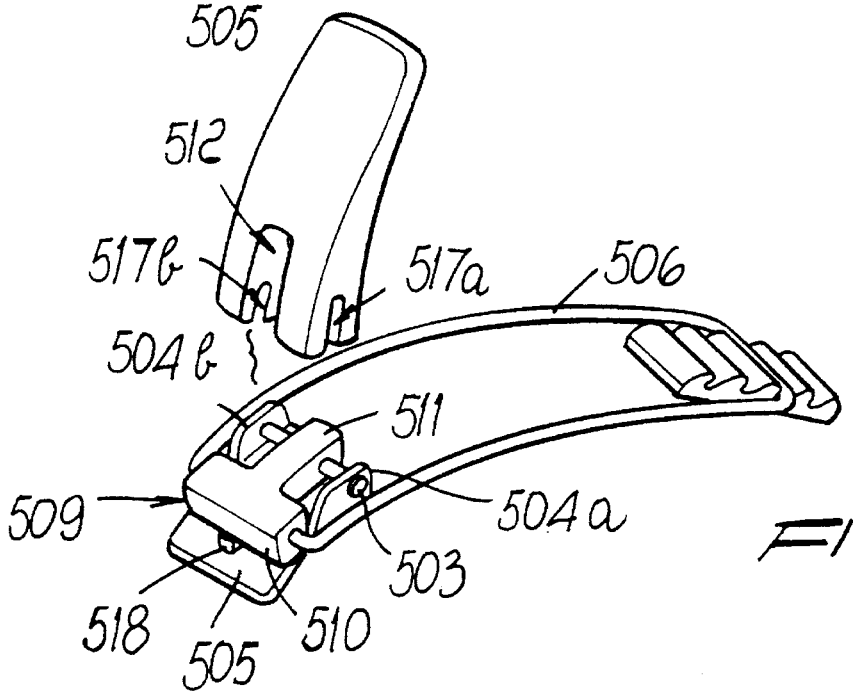
FIG. 24 is a view of the embodiment of FIG. 23 in a condition that is similar to the one shown in FIG. 21.
Figure 25:
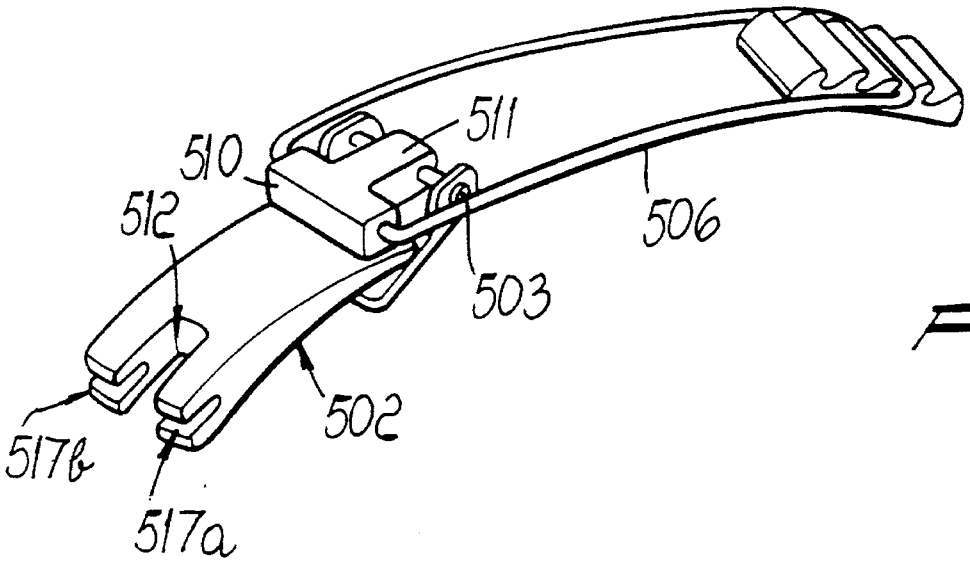
FIG. 25 is a view, similar to FIG. 24, of the embodiment of FIG. 22.

In another embodiment shown in FIGS. 23, 24, and 25, there is a fastening device 501 in which the lever arm 502 is detachably associated at the first pivot 503 about which the stem 511 of the connecting element 509 is pivoted to the first pair of wings 504*a* and 504*b* which protrudes from the base 505.

This is allowed because the end of the lever arm 502 that is adjacent to the seat 512 for the stem 511 has a suitable pair of slots 517*a* and 517*b* for engaging the first pivot 503.

Fastening can be achieved as described earlier, whereas the lever arm 502 can be stored in a pocket, for example, once fastening has been achieved.

This allows on one hand to have a single lever arm regardless of the number of fastening devices present in the shoe and on the other hand to further reduce the space occupied on said shoe.

The means for releasing the traction element 506 are essentially constituted by the tip of the lever arm 502 that does not interact with the first pivot 503; said end can be inserted in the interspace between the head 510 of the connecting element 509 and the base 505 in the active fastening condition, and this insertion is preferably facilitated by the presence, at said base 505, of a wedge-shaped protrusion 518 that is located below the stem 511.

This solution, too, therefore allows to achieve the intended aim and objects, furthermore containing the total number of components, since a single lever can be sufficient regardless of the number of fastening devices applied.

The device can of course be applied at sports shoes, such as roller skates, ice skates, snowboard boots, trekking boots, and mountaineering boots.

The materials and the dimensions that constitute the individual components of the device may of course be the most pertinent according to the specific requirements.

What is claimed is:

1. Fastening device, particularly for fastening two flaps of sports shoes, comprising a first engagement element for being rigidly coupled to a first flap and a traction element that interacts with said first engagement element, the fastening device further comprising a lever arm that is rotatably associated with a first pivot which is interposed between a first pair of wings that protrudes from a base for being associated with a second flap to be fastened, said level arm interacting on its back with said traction element to lock said traction element to a second engagement element which is arranged adjacent to said base and to subsequently place said lever arm, which bears no load, in the direction of said first engagement element, means being provided for releasing said traction element, wherein said traction element, such as a hoop, can be associated selectively at one end with said first engagement element, such as a rack, which is in turn associated with said first flap, said lever arm being articulated to said first pivot so that its back, and thus its convex part that does not face said first and second flaps in the closed condition, interacts with said traction element by means of the interposition of a connecting element, and wherein said connecting element is constituted by a T-shaped body whose head is rotatably associated with the end of said traction element that does not interact with said first engagement element.

2. Device according to claim 1, wherein said lever arm is rotatably associated, at one end, at a first pivot which is interposed transversely between said first pair of wings that protrudes from said base, said lever arm having, when inactive, its free end directed towards said first engagement element and having its back temporarily directed towards said base during the fastening of said traction element.

3. Device according to claim 1, wherein the stem of said connecting element is rotatably associated at said first pivot, the corresponding end of said lever arm having an appropriate longitudinal seat for accommodating said connecting element.

4. Device according to claim 3, wherein the longitudinal extension of said stem is such as to allow to position said head, in a flap fastening position, at said second engagement element, which is located adjacent to said base beyond said first pair of wings.

5. Device according to claim 4, wherein said back of said lever arm, when rotated towards said base, rotates said connecting element, which is arranged adjacent to said base, one end of said traction element being locked at said second engagement element.

6. Device according to claim 5, wherein once fastening has occurred said lever arm can be rotated towards said first engagement element, said lever arm being unaffected by forces suitable to maintain said fastening in this condition.

7. Device according to claim 6, wherein said lever arm interacts, when fastening has occurred, only with forces that are suitable to keep it adjacent to said first flap with its free end directed towards said first engagement element.

8. Device according to claim 7, wherein said lever arm is detachably associated at said first pivoting pin for said stem of said connecting element, said lever arm having, at the end that is adjacent to said seat for said stem, an adpated pair of slots for engagement with said first pivot.

9. Device according to claim 8, wherein said means for releasing said traction element are essentially constituted by the tip of said lever arm that does not interact with said first pivot, said tip being detachably inserted in the interspace between said head of said connecting element and said base in the fastened condition, said insertion being preferably facilitated by the presence, at said base, of a protrusion that lies below said stem and has a wedge-like shape.

10. Device according to claim 3, wherein said means for releasing said traction element are constituted by a T-shaped secondary lever whose stem is located, in closed condition, above the stem of said connecting element.

11. Device according to claim 10, wherein the free end of said stem of said secondary lever protrudes beyond the corresponding free end of said stem of said connecting element and has a pawl-like shape whose engagement tooth is directed towards said lever arm.

12. Device according to claim 10, wherein said secondary lever has a head that can be arranged adjacent to the head of said connecting element, the tips of said head of said secondary lever being folded so that they are freely rotatably associated at said head of said connecting element and coaxially to said traction element, so as to allow the free rotation of said secondary lever with respect to said head of said connecting element.

13. Device according to claim 10, wherein said means for releasing said traction element further comprise a second pivot that is pivoted transversely between the wings of said lever arm at said seat and parallel to said first pivot.

14. Device according to claim 13, wherein the arrangement of said second pivot is such that said pivot interacts, during opening, with said tooth located at the pawl-like end of said stem of said secondary lever.

15. Device according to claim 14, wherein once fastening has been completed said lever arm can be rotated towards said first engagement element, said lever arm being unaffected by forces suitable to maintain said fastening in this condition.

16. Device according to claim 15, wherein starting from the closed condition, said pawl-shaped end of said secondary lever rests at said second pivot, said traction element is under tension and said lever arm is not loaded; when said lever arm is lifted, said secondary lever rotates, optionally in contrast with a spring that is preferably arranged coaxially to the end of said traction element that is rotatably associated with said head of said connecting element.

17. Device according to claim 16 wherein the further lifting of said lever arm makes said tooth of said secondary lever interact with said second pivot so further lifting towards said engagement element allows to raise said head of said connecting element, moving the end of said traction element that is rotatably connected to said head beyond said first pivot, so as to allow disengagement from said engagement element.

18. Device according to claim 17, wherein during closure said lever arm is rotated towards said base so that said back of said wings which are adjacent to said seat interacts with the wings of said head of said connecting element, making it rotate and thus applying tension to said traction element until said head of said connecting element is arranged adjacent to said base below said first pivot in a stable closure condition.

19. Fastening device, particularly for fastening two flaps of sports shoes, comprising a first engagement element for being rigidly coupled to a first flap and a traction element that interacts with said first engagement element, the fastening device further comprising a lever arm that is rotatably associated with a first pivot which is interposed between a first pair of wings that protrudes from a base for being associated with a second flap to be fastened, said lever arm interacting on its back with said traction element to lock said traction element to a second engagement element which is arranged adjacent to said base and to subsequently place said lever arm, which bears no load, in the direction of said first engagement element, means being provided for releasing said traction element, wherein said means for releasing said traction element are constituted by a secondary lever which is arranged at a plane that is interposed between the plane of said base and the plane of said overlying lever arm, and wherein said secondary lever is obtained by bending an appropriate metal wire which has a first end that is essentially T-shaped and is pivoted at a second pair of wings that protrudes from said base in a region that lies adjacent to said head of said connecting element in a fastening position.

20. Device according to claim 19, wherein said secondary lever has a portion that lies below said connecting element and said lever arm so as to have a second end which is ring-shaped, protrudes beyond the tip of said lever arm, and is directed slightly towards said lever arm so as to form a grip means for the user.

21. Device according to claim 20, wherein the lifting of said ring-shaped end forces the lifting of said connecting element until the axis about which said head is pivoted to said traction element is arranged beyond the pivoting axis of said first pivot.

22. Device according to claim 11, wherein at least one engagement seat for one end of said traction element is formed transversely on said back of said lever arm, said traction element being rigidly associated, at its other end, with said first engagement element.

23. Device according to claim 22, wherein during the final step of the fastening of said traction element the end of said traction element that is accommodated within said first engagement seat is moved by said seat towards said second engagement element, which is located in a region that is adjacent to said first pair of wings.

24. Device according to claim 17, wherein said second engagement element comprises two recesses that allow the engagement of the end of said traction element arranged opposite to said first engagement element.

25. A fastening device, particularly for fastening two flaps of a sports shoe, comprising:

a first engagement element coupleable to a first flap portion;

a second engagement element coupleable to a second flap portion;

a lever arm having: a first end portion pivoted to said second engagement element; a second end portion; a front side arranged for facing at least one of said first and second flap portions when said lever arm is in a closed position, said front side generally facing in a first direction; and a back side arranged opposite said front side such that said back side faces a second direction generally opposite said first direction;

a traction element device having: a first end portion for connection with said first engagement element; and a second end portion for connection with said second engagement element;

wherein said lever arm and said traction element device are mutually arranged such that a sufficient pivoting movement of said lever arm in said second direction causes said second end portion of said traction element device to be arranged in a releasable closed position with respect to said second engagement element by means of an engagement of said back side of said lever arm with said second end portion of said traction element device, and wherein when said second end portion of said traction element device is in said releasable closed position said lever arm is substantially under no significant stress and said lever arm is free to be subjected to a return pivoting movement in said first direction without affecting said releasable closed position of said second end portion of said traction element device.

26. The fastening device of claim 25 further comprising means provided at said second engagement element for releasably blockingly engaging said second end portion of said traction element in said closed position.

27. The fastening device of claim 25 wherein said second end portion of said traction element device comprises a connecting element having a first end pivotally connected to said second engagement element and a second end, said traction element device comprising a traction element pivotally connected to said second end of said connecting element.

28. The fastening device of claim 27 further comprising means for pivotally connecting said first end of said connecting element to said second engagement device and means for pivotally connecting said first end portion of said lever arm to said second engagement device.

29. The fastening device of claim 28 wherein said second end portion of said traction element device is substantially arrangeable below a pivoting axis of said means for pivotally connecting said first end of said connecting element to said second engagement device with respect to an outer surface of said at least one of said first and second flap portions when said second end portion of said traction element device is in said releasable closed position.

30. The fastening device of claim 29 further comprising a secondary lever for engaging said connecting element when said second end portion of said traction element device is in said releasable closed position to lift said second end portion above said pivoting axis with respect to said outer surface.

31. The fastening device of claim 29 wherein said second end portion of said traction element device further comprises a secondary lever having a first end pivotally connected to said second end of said connecting element and a second end for extending between two lateral wings of said lever arm, said lever arm being provided with an engagement pivot extending between said two lateral wings, and said second end of said secondary lever being provided with an engagement tooth for being engaged by said engagement pivot upon a pivoting movement of said lever arm in said second direction when said second end portion of said traction element device is in said releasable closed position in order to lift said second end portion above said pivoting axis with respect to said outer surface.

32. The fastening device of claim 27 wherein said traction element comprises a looped cable element.

* * * * *